United States Patent [19]

Koskivirta et al.

[11] 4,405,259

[45] Sep. 20, 1983

[54] METHOD AND APPARATUS FOR PREVENTING FOREIGN OBJECTS FROM ENTERING INTO DOCKING BASINS

[75] Inventors: Veikko Koskivirta, Vantaa; Antti Haanterä, Helsinki, both of Finland

[73] Assignee: Valmet Oy, Finland

[21] Appl. No.: 228,727

[22] Filed: Jan. 27, 1981

[30] Foreign Application Priority Data

Jan. 29, 1980 [FI] Finland ..... 800260

[51] Int. Cl.[3] ..... E02B 15/00

[52] U.S. Cl. ..... 405/62; 405/22; 405/52

[58] Field of Search ..... 405/62, 52, 21, 22, 405/15, 211, 61, 63, 60

[56] References Cited

U.S. PATENT DOCUMENTS 2,860,600 11/1958 Cheney ..... 405/62 X
3,651,646 2/1972 Grunau ..... 405/62

FOREIGN PATENT DOCUMENTS 309121 6/1933 Italy ..... 405/62
830701 3/1960 United Kingdom ..... 405/62

*Primary Examiner*—Dennis L. Taylor
*Attorney, Agent, or Firm*—Steinberg & Raskin

[57] ABSTRACT

Method and apparatus for preventing foreign objects, such as ice floes, from entering into the docking basin of barge supporting floater-type vessels, floating docks, basin docks, canal sluices or the like, include nozzle apparatus provided at the regions of respective sides of the inlet to the docking basin for directing first and second strong, relatively narrow surface currents to create a flow field in the region of the basin inlet which prevents the foreign objects from entering into the docking basin. One of the surface currents is directed outwardly with respect to the docking basin so as to define an angle in the range of about 15° to 35° with respect to the transverse plane which passes through the inlet sides. The other surface current is directed outwardly with respect to the docking basin in a direction substantially normal to the transverse plane passing through the inlet sides.

11 Claims, 4 Drawing Figures

METHOD AND APPARATUS FOR PREVENTING FOREIGN OBJECTS FROM ENTERING INTO DOCKING BASINS

BACKGROUND OF THE INVENTION

This invention relates generally to methods and apparatus for use in so-called barge supporting floater-type vessels and the like, such as floating docks or canal sluices, for preventing ice floes or other foreign objects from entering into the docking basin and, more particularly, to such methods and apparatus wherein nozzle apparatus are utilized to create a flow field in the region of the docking basin inlet which prevents the ice floes or other foreign objects from entering into the docking basin.

A serious problem which typically arises during the docking and undocking of barges in floater-type vessels is that foreign objects, such as ice floes, tend to drift into the docking basin during entry and exit of the barge through the inlet. Such foreign objects can cause severe damage especially in situations where the same become interposed between the bottom of the vessel which is being docked and the docking deck of the floater vessel or when such foreign objects become lodged between docking supports.

Attempts have been made to overcome this problem. More particularly, experiments have been conducted wherein the inlet to the docking basin is provided with mechanical obstructions to prevent the entry of foreign objects into the docking basin during the docking of a barge or the like. However, such mechanical obstructions tend to be expensive and easily damaged during operation.

Additionally, experiments have been conducted wherein floating objects such as ice floes are prevented from entering into the docking basin by means of water currents directed outwardly from the docking basin. However, model tests have shown that the provision of such water currents does not provide an effective solution to the problem. For example, a barge having a flat bow when moving into the docking basin through an ice floe field will tend to push ice floes located in its path into the basin. Similarly, a barge having a flat stern will tend to draw such foreign objects into the docking basin behind it.

Regarding the state of the art, reference is made to applicants' Finnish publication print No. 66511 in which an arrangement is disclosed whereby a barge carrier is provided with pump apparatus by means of which water is removed from the docking basin during the docking of a barge so that an outward flow which would substantially obstruct the entry of the barge into the docking space will not be created and wherein during the exit of the barge from the docking space, water is pumped into the docking space, preferably through screens or the like, so that flow into the docking basin through the loading door is prevented. However, this arrangement does not solve the problems described above in a satisfactory manner.

SUMMARY OF THE INVENTION

Accordingly, one object of the present invention is to provide new and improved methods and apparatus for preventing the entry of foreign objects, such as ice floes or the like, from entering into the docking basin of barge supporting loader-type vessels, floating docks, basin docks, canal sluices or the like, which overcome the problems discussed above.

Briefly, in accordance with the present invention, this and other objects are achieved by providing a method and apparatus wherein a flow field is created on the surface of the water in front of the inlet to the docking basin which prevents the entry of foreign objects into the docking basin. The flow field is formed by directing at least two strong, relatively narrow surface currents in an outward direction relative to the docking basin from the regions of the respective sides of the inlet. One of the surface currents is directed outwardly at a certain angle with respect to the transverse plane which passes through the inlet sides, the angle preferably being in the range of between about 15° to 35°. The other surface current is directed substantially rearwardly at right angles to the transverse plane which passes through the inlet sides.

In order to accomplish the method of the present invention, apparatus are provided in connection with the floater-type vessel or the like whereby nozzle apparatus are installed in the region of the inlet to the docking space for directing the surface currents in the manner described above. The water which forms the surface currents is supplied to the nozzle apparatus by pumps from a source or sources specifically adapted such that the pumping operation will not substantially disturb the surface currents. For example, the water can be obtained from bilge wells provided in the docking basin.

Although the most advantageous application of the present invention is in connection with floater-type barge transporting vessels, it is understood that the invention can also be used in connection with floating docks, basin docks, canal sluices or the like. In such applications, the problem of entry of foreign objects into the docking basin is not as serious as in connection with floater-type vessels.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
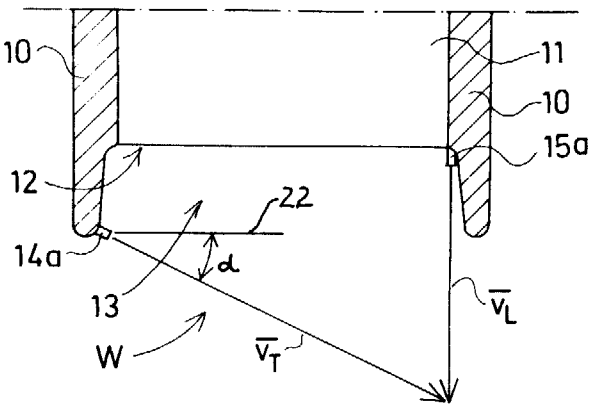
FIG. 1 is a diagrammatic plan view of the aft section of a so-called floater-type barge transporting vessel illustrating the method of the present invention.

Referring now to the drawings wherein like reference characters designate identical or corresponding parts throughout the several views, the aft section of a barge-supporting floater-type vessel is illustrated comprising side walls 10 defining a docking basin 11 between them. The rearward edge of the docking basin 11 is designated 12. The floater-type vessel illustrated also includes a stern door which is not illustrated for purposes of clarity. It will be understood by those skilled in the art that the stern door is closed after the barge is floated into the docking basin 11 and is opened when the barge exits from the docking space. In any event, a two-sided inlet is defined between the end regions of the side walls 10 through which barges pass in order to enter into the docking basis 11.

A pair of nozzles 14*a* and 15*a* are provided, each being mounted at a respective side of the inlet to the docking basin 11. In most situations, the nozzles 14*a* and 15*a* will be provided on respective sides of the docking door (not shown) which will be situated in the area designated 13.

Referring to FIG. 1, the nozzles 14*a* and 15*a* direct strong, relatively narrow surface currents $\overline{v}_T$ and $\overline{v}_L$, respectively outwardly with respect to the docking basin 11 and in the particular directions illustrated.

According to the method of the invention, the surface current $\overline{v}_T$ is directed by nozzle 14*a* transversely across the region of the docking basin inlet or door region 13 while the surface current $\overline{v}_L$ produced by nozzle 15*a* is directed substantially rearwardly from one side wall 10 of the vessel. The combined influence of the surface currents $\overline{v}_T$ and $\overline{v}_L$ create a flow field in the region W rearward of the inlet to the docking basin 11 which effectively prevents ice floes or other foreign objects floating on or under the surface of the water from entering into the docking basin 11 through the docking door 13 during docking of barges, such as barges 21 in FIG. 3, into the docking basin 11.

Thus, in the illustrated embodiment the present invention is applied to a barge supporting floater-type vessel with the nozzles 14*a* and 15*a* being located on respective sides of a docking door situated in the area designated 13. As noted above, however, the invention also finds beneficial use in connection with floating docks, basin docks, canal sluices or the like in which cases the respective nozzles are situated on respective sides of the inlet to the docking basin of each.

The operability and efficiency of the method and apparatus described above have been proven in model tests. Such testing has also shown that in order to provide the most efficient flow field in the region W, the surface current $\overline{v}_T$ should have a direction which defines an angle $\alpha$ with respect to a transverse plane 22 which passes through the inlet sides so that the surface current $\overline{v}_T$ comprises a transversal current which is directed rearwardly from the docking door. The angle $\alpha$ is suitably in the range of between about 15° to 35° and preferably in the range of from about 20° to 30°. The longitudinal current $\overline{v}_L$ is essentially directed rearwardly so as to be substantially normal to the transverse plane 22 passing through the inlet sides. However, it is understood that the direction of the rearward current $\overline{v}_L$ can vary to some extent, for example, in the direction of the region W toward the docking door 13.

The surface currents $\overline{v}_L$ and $\overline{v}_T$ which produce an unsymmetric flow field should be sufficiently strong to provide adequate assurance against the entry of foreign objects to the docking basin. It has been estimated that the power required for producing the currents $\overline{v}_T$ and $\overline{v}_L$ is in the range of about 300 to 600 kW. It has also been noted that the strength or power of the transverse current $\overline{v}_T$ should preferably be substantially higher than the power or strength of the longitudinal current $\overline{v}_L$ and good results have been obtained where the power of the transverse current $\overline{v}_T$ is about twice as high as that of the longitudinal current $\overline{v}_L$.

Ice floes and the like are prevented from entering into the docking basin 11 in a reliable manner by choosing the angle $\alpha$ to be in the range set forth above. Should $\alpha$ be selected to be substantially smaller than 15°, the ice floes and the like might possibly become situated so close to the inlet or docking door that the same might be pushed by a barge 21 (FIG. 3) into the docking basin 11. On the other hand, should $\alpha$ be selected substantially larger than 35°, the surface current $\overline{v}_T$ would be substantially less effective in preventing foreign objects from entering the docking basin 11 which would consequently require the power of the surface $\overline{v}_T$ to be increased to an unreasonably high level.

The longitudinal current $\overline{v}_L$ functions to prevent ice floes or the like from moving from the side of the vessel into the docking basin and to create a flow field together with the transverse current $\overline{v}_T$ which will prevent ice floes or the like from entering into the docking basin in all situations with a relatively high probability.

Figure 3:
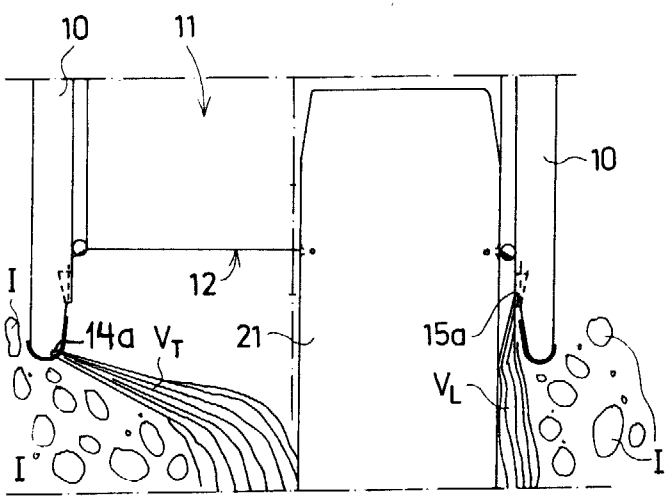
FIG. 3 is a diagrammatic plan view of the aft end of the floater-type barge transporting vessel illustrating the entry of a barge into a docking space in accordance with the present invention.

Model tests have also shown that the method of the present invention is beneficial in that the docking operation can be accomplished in a rapid manner. It has been noted in this connection that a certain path of movement is preferred when barges are pushed into the docking basin 11. Referring to FIG. 3, a barge 21 is pushed through the inlet into the docking basin 11 preferably close to the side 10 of the floater-type vessel at which the nozzles for directing the longitudinal current $\overline{v}_L$ is located. Such a docking procedure has proven to be quite practical. Thus, FIG. 3 illustrates a barge 21 entering docking basin 11 and the surface currents directed from the nozzles 14*a* and 15*a* form flow patterns $\overline{V}_T$ and $\overline{V}_L$ which prevent ice floes I from entering into the docking basin.

Figure 2:
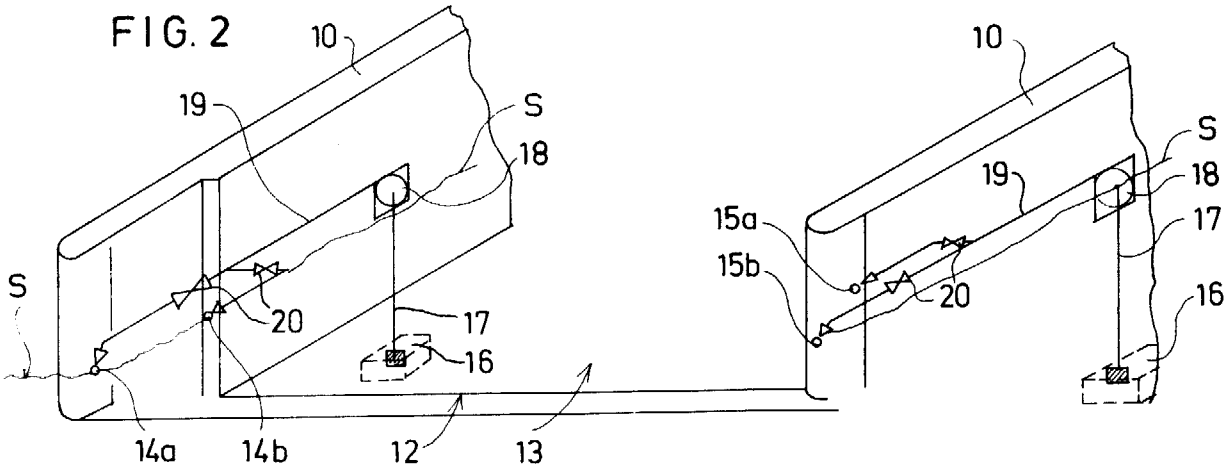
FIG. 2 is a diagrammatic perspective view of the aft section of a floater-type barge transporting vessel illustrating apparatus for directing two surface currents in accordance with the present invention.

Turning now to FIG. 2, apparatus for producing the currents $\overline{v}_T$ and $\overline{v}_L$ and its location relative to the inlet area 13 of the vessel is illustrated. The source of water for producing the surface currents in chosen such that the drawing or suction of the water from such source will not disturb the surface currents. For example, bilge wells 16 provided at the bottom of the vessel are preferably utilized.

Each side 10 of the vessel is provided with apparatus for creating the respective surface currents described above. In the illustrated embodiment, a pair of nozzles are provided on each side of the inlet for creating a respective surface current. More particularly, nozzles 14*a* and 14*b* are provided for creating the transverse surface current $\overline{v}_T$ while nozzles 15*a* and 15*b* are provided for creating the longitudinal surface current $\overline{v}_L$.

Each group of nozzles are associated with apparatus for supplying water thereto for creation of the respective surface current. Thus, each group of nozzles is associated with a pump 18 adapted to pump water through a pipe 17 from a respective bilge well 16 and conduct the water through pipes 19 and valves 20 to the respective nozzle group. The valves 20 are located in branch portions of the pipe 19 so that through suitable control of the valves, the particular nozzle 14*a* or 14*b* (or nozzle 15*a* or 15*b*) can be open or closed and the power of the current created thereby adjusted. Thus, the pair of nozzles 14*a* and 15*a* can be used alone for providing the transverse and longitudinal surface currents. However, by closing suitable valves 20, the nozzles 14*a* and 15*a* can be inactivated and by opening the other valves associated with nozzles 14*b* and 15*b*, the latter can be made to function and the flow pattern thus can be changed.

For example, particular ice floe conditions or docking conditions can determine the particular flow field which is necessary in a particular situation. In certain cases, both nozzles 14*a* and 14*b* (and 15*a* and 15*b*) can be used at the same time although the flow pattern should be maintained substantially as described above.

Figure 4:
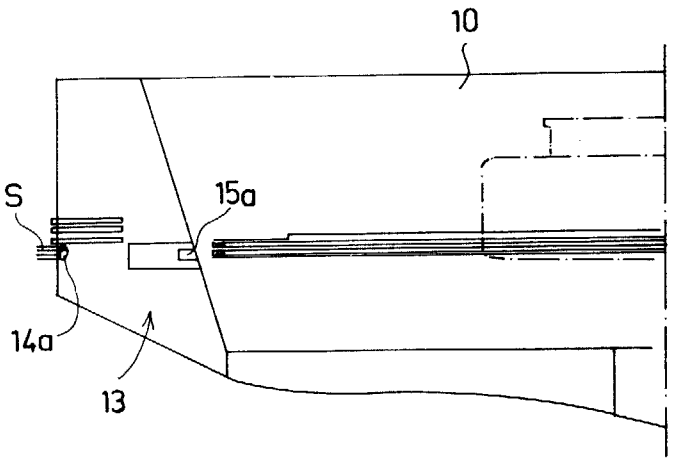
FIG. 4 is a side view of the aft section of a floater-type barge transporting vessel equipped with apparatus according to the present invention.

As shown in FIGS. 2 and 4, the nozzles 14 and 15 are preferably located slightly beneath the surface S of the water. During docking of barges, the draft of the vessel will remain substantially constant so that the nozzles will be maintained close to the water surface. In cases where the draft can vary, the nozzles 14 and 15 can be installed in suitable devices so that the height of the nozzles can be varied according to the draft.

As noted above, the surface currents $\overline{v}_T$ and $\overline{v}_L$ should be quite strong in order to obtain the desired results. It has been estimated that the surface currents $\overline{v}_T$ and $\overline{v}_L$ together should add to a value of about 3,000 to 5,000 cubic meters per hour at a pressure of about 1.5 aty in order to produce the desired results. As also noted above, the currents $\overline{v}_T$ and $\overline{v}_L$ should be relatively sharp or narrow, i.e., well defined.

In the illustrated embodiment, the barge supporting vessel is provided with equipment which is fixed in place in order to provide the flow field in accordance with the invention, in the region of the loading door of the vessel. However, it is understood that the method and apparatus of the invention can be practiced utilizing removable equipment which is installed in the area of the loading door or inlet of the vessel only during loading or unloading of barges.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for preventing foreign objects, such as ice floes, from entering through a two-sided inlet into the docking basin of barge supporting floater-type vessels, floating docks, basin docks, canal sluices or the like, comprising the steps of:

directing a first strong, relatively narrow surface water current in an outward direction with respect to the docking basin from the region of one side of the inlet, said first surface current defining an angle in the range of about 15° to 35° with respect to a transverse plane passing through the inlet sides so as to constitute a transverse current; and directing a second strong, relatively narrow surface water current in an outward direction with respect to the docking basin from the region of the other side of the inlet, said second surface current being directed substantially normal to the transverse plane passing through the inlet sides so as to constitute a rearward current;

whereby a flow field is created by the transverse and rearward currents which prevents foreign objects from entering into the docking basin through the inlet.

2. The methosd of claim 1 wherein the angle defined by the transverse current and transverse plane is in the range of about 20° to 30°.

3. The method of claim 1 wherein the transverse current is substantially stronger than the rearward current.

4. The method of claim 3 wherein the transverse current in about twice as strong as the rearward current.

5. Apparatus for preventing foreign objects from entering through a two-sided inlet into the docking basin of barge supporting floater-type vessels, floating docks, basin docks, canal sluices or the like, comprising:

first means for directing a first strong, relatively narrow surface water current in an outward direction with respect to the docking basin from the region of one side of the inlet, said first surface current defining an angle in the range of about 15° to 35° with respect to a transverse plane passing through the inlet sides so as constitute a transverse current; and second means for directing a second strong, relatively narrow surface water current in an outward direction with respect to the docking basin from the region of the other side of the inlet, said second surface current being directed substantially normal to the transverse plane passing through the inlet sides so as constitute a rearward current;

whereby a flow field is created by the transverse and rearward currents which prevents foreign objects from entering into the docking basin through the inlet.

6. The combination of claim 5 wherein said apparatus is associated with the docking basin of a barge supporting floater-type vessel, said docking basin being defined by a pair of side walls, and wherein said first and second means each include at least one nozzle mounted on a respective side wall of the vessel adjacent said inlet, a pipe system mounted on said respective vessel side wall fluidly communicating with said nozzle, pump means mounted on the vessel for supplying water from a source to said pipe system into said nozzle, and wherein the source for supplying water to said pipe system include a well provided in the hull of the vessel.

7. The combination of claim 6 wherein said nozzles are situated at said inlet side regions substantially at or slightly below the level corresponding to the draft of a vessel which is to be docked in the docking basin.

8. The combination of claim 6 wherein said first and second means each include at least two nozzles provided at the region of a respective inlet side and wherein said pipe system includes valve means for selectively opening or closing one or more of said nozzles.

9. The combination of claim 5 wherein the angle defined by the transverse current and transverse plane is in the range of about 20° to 30°.

10. The combination of claim 5 wherein the transverse current is substantially stronger than the rearward current.

11. The combination of claim 10 wherein the transverse current is about twice as strong as the rearward current.

* * * * *